US005201648A

United States Patent [19]

Lakowske

[11] Patent Number: 5,201,648

[45] Date of Patent: Apr. 13, 1993

[54] SCREW COMPRESSOR MECHANICAL OIL SHUTOFF ARRANGEMENT

[75] Inventor: Rodney L. Lakowske, La Crosse, Wis.

[73] Assignee: American Standard Inc., New York, N.Y.

[21] Appl. No.: 938,801

[22] Filed: Sep. 1, 1992

[51] Int. Cl.[5] ..... F01C 1/24

[52] U.S. Cl. ..... 418/201.2; 418/87; 418/99; 418/84

[58] Field of Search ..... 418/201.2, 84, 87, 99, 418/98

[56] References Cited

U.S. PATENT DOCUMENTS

| | | | |
|---|---|---|---|
| 3,243,103 | 3/1966 | Bellmer | 418/87 |
| 3,905,729 | 9/1975 | Bauer | 418/84 |
| 4,497,185 | 2/1985 | Shaw | 418/99 |
| 4,762,469 | 8/1988 | Tischer | 417/279 |

*Primary Examiner*—Richard A. Bertsch
*Assistant Examiner*—Charles G. Freay
*Attorney, Agent, or Firm*—William J. Beres; William O'Driscoll; Peter D. Ferguson

[57] ABSTRACT

An integral member is disposed internal of a refrigeration screw compressor which, upon compressor shutdown, shuts off the flow of oil injected into the compressor's working chamber as well as the oil directed to the compressor rotor bearings and which, at compressor startup, opens oil flow to those locations by the use of ambient internal compressor conditions that inherently exist at those respective times. The operation of the apparatus is therefore "fail safe" and the need for external oil flow cutoff valving and the need to monitor and/or prove oil flow within the compressor is eliminated.

14 Claims, 2 Drawing Sheets

SCREW COMPRESSOR MECHANICAL OIL SHUTOFF ARRANGEMENT

BACKGROUND OF THE INVENTION

The subject matter of this patent is related to the subject matter of earlier filed U.S. patent application Ser. No. 07/926,797, assigned to the assignee of the present invention, and relates generally to the art of compressing a gas in an oil-injected rotary screw compressor. More specifically, the present invention relates to apparatus for isolating rotor bearing lubricant passages and the oil injection port, which opens into the working chamber of an oil injected screw compressor, from their oil supply upon compressor shut down.

Screw compressors employed in refrigeration systems are comprised of complementary male and female screw rotors disposed within a working chamber defined by a rotor housing. The working chamber can be characterized as a volume generally shaped as a pair of parallel intersecting cylindrical bores and is closely toleranced to the outside length and diameter dimensions of the intermeshed screw rotor set. The rotor housing has low and high pressure ends which define unvalved suction and discharge ports in open-flow communication with the working chamber.

In operation, refrigerant gas at suction pressure enters the working chamber via the suction port and is enveloped in a chevron shaped pocket formed between the counter-rotating screw rotors. The pocket closes, its volume decreases and it is displaced toward the high pressure end of the compressor as the rotors meshingly rotate within the working chamber. The gas within such a pocket is compressed by virtue of the decreasing volume in which it is contained until the pocket opens to the discharge port at the high pressure end of the working chamber where it is expelled through the discharge port.

Due to the extremely close tolerances between the rotor set and the walls of the working chamber, the bearing arrangement in which the rotor set is mounted is critical to compressor operation and life. This is particularly true because the bearings and rotors in a screw compressor are subject to high and variable axial and radial loads. Protection and lubrication of rotor bearings is therefore of paramount concern in the design and operation of rotary screw compressors.

In addition to being delivered to the rotor bearings, oil is in many instances injected into the working chamber of a screw compressor through an injection port to perform several functions. First, the oil injected into the working chamber acts as a sealant between the rotors and the surfaces of the working chamber in which the rotors are disposed.

The oil also acts as a lubricant between the driving and driven screw rotor. In that regard, one of the two screw rotors is driven by an external source, such as an electric motor, while the other rotor is driven by virtue of its meshing relationship with the motor-driven rotor. Oil injected into the working chamber of the compressor therefore acts to prevent excessive wear between the driving and driven rotors.

Finally, injected oil is used to cool the refrigerant undergoing compression within the working chamber which in turn reduces the thermal expansion of the rotors that would otherwise occur as a result of the heat generated by the compression process. Such injection cooling therefor permits tighter rotor to housing clearances from the outset.

At compressor shut down, when the drive motor is de-energized, the backflow of discharge pressure gas from the high (downstream) side of the refrigeration system in which a screw compressor is employed back through the compressor discharge port, if allowed to occur, causes the high speed reverse direction rotation of the no longer driven screw rotors within the working chamber. Such reverse direction freewheeling of the rotors can occur at speeds greater than the maximum design RPM of the rotor set for normal operation.

Additionally, the resulting rush of downstream discharge pressure gas back through the compressor toward the low pressure side of the refrigeration system under such conditions is such that a relatively higher pressure can momentarily develop at the suction end of the compressor than exists at the discharge end of the compressor. This situation can result in the development of inordinate and uncommonly large axial forces on the screw rotor set and rotor bearings in a direction opposite that which is normally encountered and compensated for during compressor operation.

Also, many screw compressor bearing lubrication schemes are predicated on the development and maintenance of relatively high pressure downstream of the compressor which is used to drive lubricating oil from a sump or reservoir to the rotor bearings and/or injection port. The high speed reverse rotation of the rotor set at compressor shutdown and momentary development of relatively higher pressure at the upstream or low side end of the working chamber, if allowed to occur, can cause oil to be sucked from the bearings or not to be delivered to the bearings in sufficient quantity with potentially catastrophic results.

Finally, unless the oil injection port opening into the working chamber of a screw compressor is isolated from its typically pressurized oil supply upon compressor shutdown, oil will continue to flow through the injection port into the working chamber after shutdown, until the system pressures equalize, by virtue of the pressure differential which exists between the oil supply and the working chamber at compressor shutdown. Absent means for reliably isolating the oil injection port from its oil supply under such circumstances, the working chamber can become flooded with oil. As a result, excessive rotor deflection can occur and/or the compressor lubrication system can become starved for oil due to the dislocation of the oil supply from the oil sump to the working chamber. Under the first circumstance rotor to housing rubbing can occur while under the second circumstance insufficient oil may be available for delivery to the necessary locations within the compressor when the compressor next starts with potentially catastrophic results.

The need, therefore, continues to exist for a fail safe arrangement for preventing the continued flow of oil to the bearings and through the injection port into the working chamber of a refrigeration screw compressor upon compressor shut down and for permitting such oil flow at compressor startup.

SUMMARY OF THE INVENTION

It s an object of the present invention to isolate the bearing lubrication passages and the oil injection port which opens into the working chamber of a screw compressor from their oil supply upon compressor shutdown in a manner which is actuated by the existence of discharge pressure gas immediately downstream of the compressor's working chamber when the compressor is in operation.

A further object of the present invention is to provide an arrangement which, by the act of compressing gas and discharging it from the compressor's working chamber upon compressor start up, immediately and mechanically places the bearing lubrication passages and oil injection port into flow communication with their oil supply.

It is also an object of the present invention to provide mechanical apparatus for closing the bearing lubrication passages and oil injection port of a screw compressor immediately upon compressor shutdown and for opening them immediately upon startup in a manner which, by its use of ambient conditions which are inherent within the compressor at those respective times, is "fail safe" and eliminates the need for external check valves, solenoid valves or sensors to "prove" oil flow within the compressor.

These and other objects of the present invention, which will become apparent when the Drawing Figures and the Description of the Preferred Embodiment hereof are considered, are accomplished by apparatus disposed within a screw compressor which shuts off the flow of injection and bearing lubrication oil in the compressor at compressor shutdown and which permits flow to occur at compressor startup by the use of the internal pressure differentials and gas flow which are inherent in the compressor and its operation at those respective times.

Discharge pressure, which exists immediately downstream of the compressor's discharge port when the compressor is in operation, is used to position an integral oil cutoff and discharge check valve to a position which permits the flow of lubricating oil from an oil supply to bearing locations and to the oil injection port opening into the compressor's working chamber while the compressor is in operation. At compressor shutdown the backflow of discharge pressure gas to the compressor's working chamber acts on the check portion of the valve to position it such that the oil cutoff portion of the valve isolates the oil supply from the compressor bearings and injection port. Upon compressor startup discharge pressure quickly develops immediately downstream of the compressor's working chamber and acts on the check portion to reposition the valve such that its oil flow cutoff portion is retracted which immediately permits oil to be directed to the bearings and oil injection port.

BRIEF DESCRIPTION OF THE DRAWING FIGURES

DESCRIPTION OF THE PREFERRED EMBODIMENT

Figure 1:
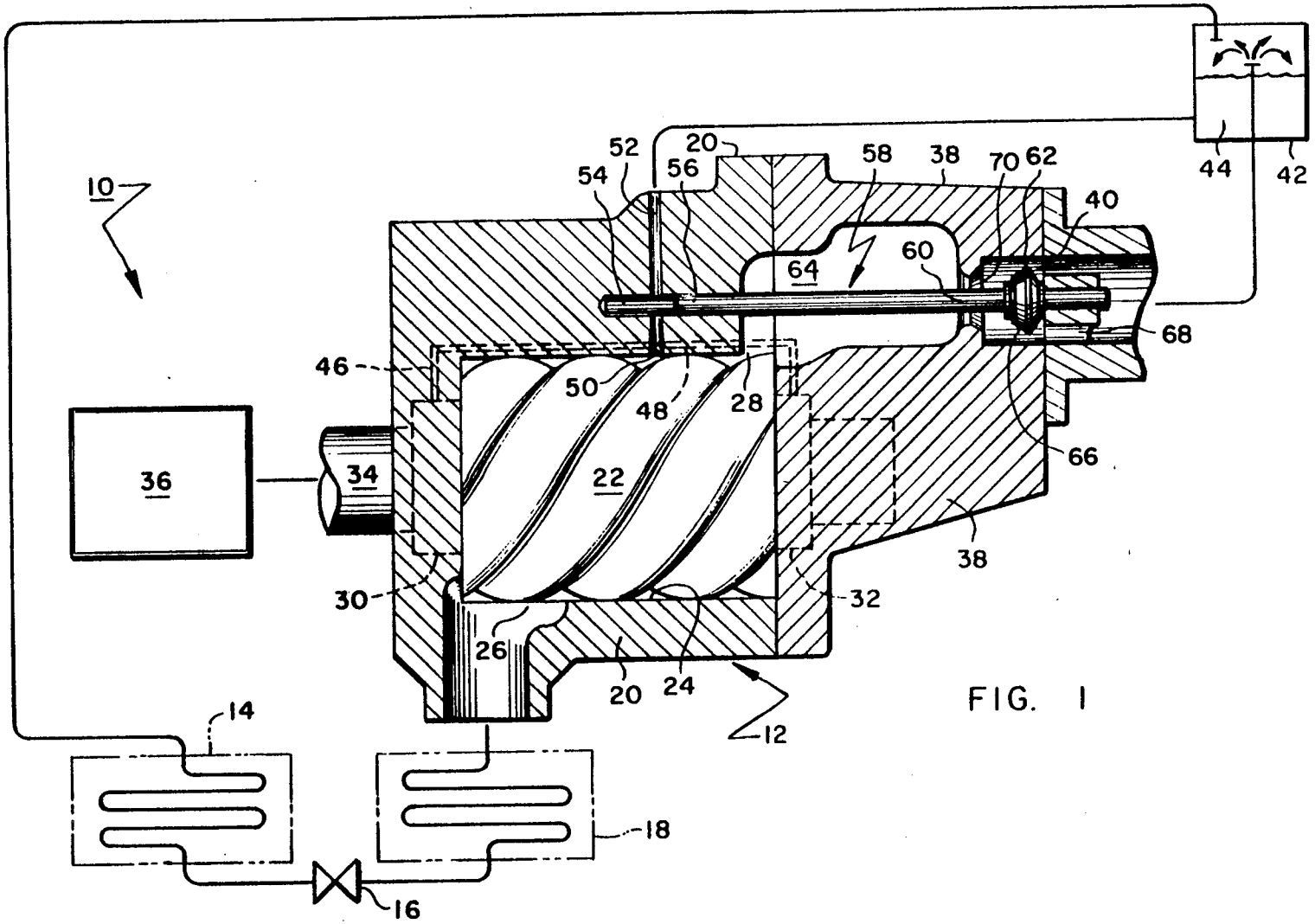
FIG. 1 is a cross sectional view of the compressor of the present invention and its schematic disposition in a refrigeration system.
Figure 2:
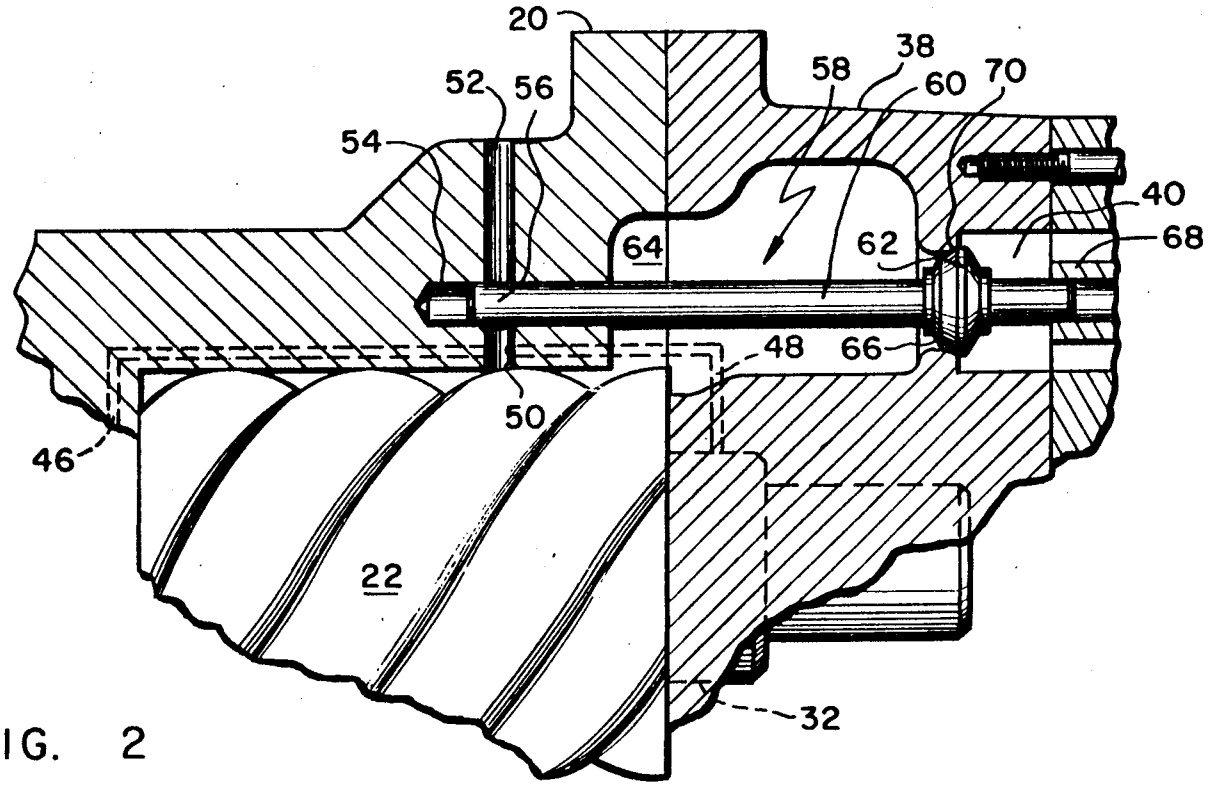
FIG. 2 is an enlarged partial view of the integral discharge check an oil cutoff valve installation in the compressor of FIG. 1 illustrating the valve in a position in which oil flow within the comperssor is prevented.

Referring concurrently to Drawing FIGS. 1 and 2, refrigeration system 10 is comprised of a compressor housing assembly 12, condenser 14, expansion valve 16 and evaporator 18 all of which are serially connected to form a hermetic closed loop refrigeration system. Rotor housing 20 of compressor assembly 12 houses a pair of screw rotors one of which, rotor 22, is illustrated. The rotor set is disposed in working chamber 24 of the rotor housing which further defines a suction port 26 and discharge port 28 which are, respectively, the entry and exit locations for refrigerant gas passing through the working chamber during compressor operation.

Rotor 22 is the driven one of the pair of screw rotors and is mounted for rotation within the rotor housing in bearings 30 and 32. Rotor 22 has a shaft 34 extending from one of its ends which is driven by motor 36. Bearing housing 38 of the compressor assembly is attached to the discharge end of rotor housing 20 and serves to house bearing 32 and to close the discharge end of the working chamber.

Bearing housing 38 defines a discharge passage 40 which is in flow communication with discharge port 28 and which channels discharge gas out of the compressor assembly. Discharge passage 40 is also in flow communication with oil separator 42 in which lubricant, which has been carried out of compressor housing assembly 12 in the discharge gas stream, is separated from the discharge gas prior to the use of that gas in the refrigeration system. It is to be noted that a relatively large amount of oil is typically carried out of the compressor's working chamber in the discharge gas stream in an oil-injected screw compressor and that as much of that entrained oil as possible must be removed from the refrigerant gas so as not to degrade downstream refrigeration system performance and to ensure that sufficient lubricant continues to be available to the compressor.

Compressor assembly 10 defines a plurality of oil passages including lubrication passages 46 and 48 which communicate with the bearings that support the screw rotors within the compressor assembly and with an oil injection passage 50 which opens into the compressor's working chamber. In the embodiment illustrated in FIGS. 1 and 2, all three passages flow into common oil supply passage 52.

Oil supply passage 52 is in flow communication with sump 44 of oil separator 42. It is to be noted that oil separator 42 and sump 44 may be integral to the compressor assembly and that sump 44 might communicate with supply passage 50 via passages which are entirely internal of the compressor assembly in such instances. Also, oil sump 44 may be physically removed and in a vessel separate from oil separator 42.

Interposed in oil supply passage 52 in rotor housing 20 is a volume 54, which will preferably be a bore drilled into housing 20, in which oil cutoff portion 56 of valve member 58 is disposed. Oil cutoff portion 56 of valve member 58 is a first distal end of spindle 60 which has an integral discharge check portion 62 disposed on it. Spindle 60 traverses area 64 which is an area within the compressor assembly immediately downstream of discharge port 28 that is at discharge pressure when the compressor is in operation. Spindle 60 is supported for axial movement at a second distal end in spider 68 as well as at its first distal end within volume 54 of rotor housing 20.

The discharge of compressed gas from working chamber 24 acts to elevate the pressure within area 64. That pressure acts on end face 66 of check portion 62 to urge it into abutment with spider 68 thereby permitting the flow of discharge pressure gas from the compressor assembly through passage 40 when the compressor is in operation. This movement causes spindle 60 to be carried into the position illustrated in FIG. 1 in which oil cutoff portion 56 of valve 58 is moved out of registry with oil supply passage 52 thereby putting passage 52 into flow communication with oil supply passages 46, 48 and 50.

Upon compressor shutdown, the backflow of compressed gas through passage 40 from downstream of the compressor assembly to the compressor's working chamber carries check portion 62 of valve member 58 into abutment with seating surface 70 of bearing housing 38. As a result. spindle 60 is positioned such that its first distal end, oil cutoff portion 56, occludes oil supply passage 52 thereby cutting off oil supply passages 46, 48 and 50 from their oil supply. When the compressor next starts, valve 58 is immediately repositioned by internal startup conditions to connect passages 46, 48 and 50 to their oil supply.

It will be appreciated that since the oil shutoff arrangement of the present invention is mechanical and fail safe, relying on inherent internal compressor operating conditions for actuation at appropriate times the need for "proving" oil flow to the compressor bearings and oil injection port at compressor startup is avoided. The arrangement of the present invention likewise eliminates the need for electrical or electronic sensing and/or monitoring with respect to oil flow during compressor operation and, with respect to some systems, the need to employ a relatively expensive solenoid operated valve, which is subject to electrical failure, to interrupt and open the oil supply line at appropriate times.

While the present invention has been described in terms of a preferred embodiment, it will be appreciated that there are modifications to the invention which will be apparent to those skilled in the art. Therefore, the scope of the present invention is not limited other than with respect to the language of the claims which follow.

What is claimed is:

1. A refrigerant gas compressor of the screw type comprising:

a housing defining a working chamber, said housing further defining a suction port, a discharge port and an oil supply passage, all in flow communication with said working chamber, said housing still further defining an oil flow cutoff passage in flow communication with said oil supply passage;

a pair of screw rotors meshingly disposed for rotation in said working chamber; and integral valve means disposed within said compressor and positionable (i) to simultaneously occlude said oil supply passage to prevent the flow of oil therethrough and to stop the backflow of previously compressed gas back to the compressor's working chamber at compressor shutdown and (ii) to simultaneously open said oil passage to permit the flow of oil therethrough and permit the discharge of compressed gas from said compressor immediately subsequent to compressor startup, all in direct response to ambient conditions in said compressor, downstream of said discharge port, which inherently exist at compressor shutdown and startup respectively.

2. The screw compressor according to claim 1 wherein said integral valve means is a unitary member having an oil shutoff portion and a discharge check portion.

3. The screw compressor according to claim 2 wherein said unitary member is comprised of a spindle on which said discharge check valve portion is disposed.

4. The screw compressor according to claim 3 wherein said oil shutoff portion comprises a first distal end of said spindle said first distal end being disposed for axial movement in said oil flow cutoff passage.

5. The screw compressor according to claim 4 wherein said compressor defines a seating surface, the backflow of gas to said working chamber from downstream thereof which occurs upon compressor shutdown causing said discharge check portion of said unitary member to seat on said surface so as to stop said backflow, the movement of said discharge check portion to said seated position causing corresponding movement of said first distal end of said spindle into a position within said oil flow cutoff passage in which said first distal end of said spindle occludes said oil supply passage.

6. The screw compressor according to claim 5 wherein said compressor defines an area which is downstream of said discharge port and upstream of said seating surface, said area being at discharge pressure when said compressor is in operation, said spindle traversing said area.

7. The screw compressor according to claim 6 wherein said housing is comprised of a rotor housing and a bearing housing, said oil flow cutoff passage being a bore drilled into said rotor housing and said discharge check portion being disposed in said bearing housing downstream of said seating surface.

8. A screw compressor-based refrigeration system comprising:

an oil supply a condenser;

an expansion valve;

an evaporator; and a screw compressor, said compressor, condenser, expansion valve and evaporator being serially connected to form a hermetically closed refrigeration system, said compressor (a) defining a working chamber in which a pair of screw rotors are disposed, an oil supply passage in flow communication with said oil supply, a suction port in open flow communication with said working chamber, a discharge port in open flow communication with said working chamber, an oil cutoff passage in flow communication with said oil supply passage; and (b) having integral valve means, disposed internal of said compressor, positionable (i) to simultaneously stop the backflow of previously compressed gas back to the compressor's working chamber upon compressor shutdown and to occlude said oil supply passage to prevent the flow of oil therethrough in response to ambient conditions downstream of said discharge port which inherently exist immediately subsequent to compressor shutdown and (ii) to simultaneously permit the discharge of compressed gas from said compressor immediately subsequent to compressor startup and to open said oil passage to permit the flow of oil therethrough in response to ambient conditions downstream of said discharge port which inherently exist immediately subsequent to compressor startup.

9. The screw compressor according to claim 8 wherein said integral valve means is a unitary member having an oil shutoff portion and a discharge check portion.

10. The screw compressor according to claim 9 wherein said integral valve means is comprised of a spindle on which a discharge check portion is disposed.

11. The screw compressor according to claim 10 wherein said spindle has a first distal end disposed for axial movement in said oil flow cutoff passage.

12. The screw compressor according to claim 11 wherein said compressor defines a seating surface, the backflow of gas to said working chamber from downstream thereof which occurs upon compressor shutdown acting on said discharge check portion of said integral valve means to cause it to seat on said surface so as to stop said backflow, the movement of said discharge check portion to said seated position causing corresponding movement of said first distal end of said spindle into a position in which said first distal end occludes said oil supply passage.

13. The screw compressor according to claim 12 wherein said compressor defines an area downstream of said discharge port and upstream of said seating surface which is at discharge pressure when said compressor is in operation, said spindle traversing said area.

14. The screw compressor according to claim 13 wherein said housing is comprised of a rotor housing and a bearing housing, said oil flow cutoff passage being a bore drilled into said rotor housing, and wherein said discharge check valve portion of said valve is disposed in said bearing housing downstream of said seating surface.

* * * * *